United States Patent [19]

Conti et al.

[11] 4,023,384

[45] May 17, 1977

[54] KNIT TUBULAR ARTICLE WITH TRANSVERSE WAIST OPENING

[75] Inventors: Paolo Conti; Massimo Bianchi, both of Florence, Italy

[73] Assignee: Billi, S.p.A., Florence, Italy

[22] Filed: Apr. 12, 1974

[21] Appl. No.: 460,583

[30] Foreign Application Priority Data

Apr. 13, 1973 Italy ..... 9419/73

[52] U.S. Cl. ..... 66/172 E; 66/177

[51] Int. Cl.[2] ..... D04B 9/46

[58] Field of Search ..... 66/172 R, 172 E, 175, 66/176, 177

[56] References Cited

UNITED STATES PATENTS

| | | | |
|---|---|---|---|
| 2,285,012 | 6/1942 | Burkey | 66/177 |
| 2,887,860 | 5/1959 | Bellman | 66/172 R |
| 3,159,990 | 12/1964 | Monday | 66/172 E |
| 3,262,288 | 7/1966 | Burd | 66/172 R |
| 3,670,529 | 6/1972 | Fregeolle | 66/177 |
| 3,673,821 | 7/1972 | Johnson | 66/177 |
| 3,748,870 | 7/1973 | Fregeolle | 66/177 |
| 3,815,385 | 6/1974 | Gariboldi | 66/177 |
| 3,924,423 | 12/1975 | Lonati | 66/172 E X |

FOREIGN PATENTS OR APPLICATIONS

| | | | |
|---|---|---|---|
| 2,206,762 | 6/1974 | France | 66/177 |
| 2,017,339 | 5/1970 | France | 66/177 |
| 2,300,955 | 7/1974 | Germany | 66/177 |
| 2,038,212 | 3/1971 | Germany | 66/177 |
| 1,938,623 | 2/1970 | Germany | 66/177 |
| 2,034,010 | 1/1971 | Germany | 66/177 |

OTHER PUBLICATIONS

Goadby, D. R., *Billi's Pair of One-Piece Pantie-Hose*, in the Hosiery Trade Journal, 80(954), pp. 99–100, June 1973.

Santoni "Thread Through" is the latest Pantie-Hose Development, in the Hosiery Trade Journal, p. 13, Sept. 1972.

*Primary Examiner*—Mervin Stein
*Assistant Examiner*—Andrew M. Falik
*Attorney, Agent, or Firm*—Clifton T. Hunt, Jr.

[57] ABSTRACT

A continuous tubular one-piece panty hose is formed on a circular knitting machine, wherein the waist opening extends transversely of the direction of knitting and is surrounded by a reinforced elastic section with stitches that resist raveling or breakdown.

4 Claims, 10 Drawing Figures

| | | | | |
|---|---|---|---|---|
| K | K | K | K | K |
| K | K | K | K | K |
| T | K | T | K | T |
| K | K | K | K | K |
| T | K | T | K | T |

K = KNIT
T = TUCK

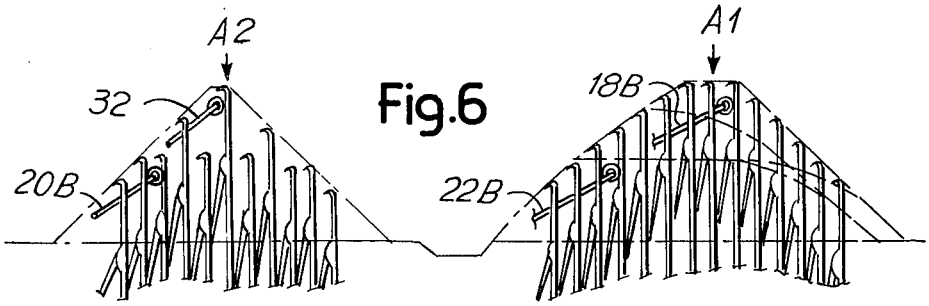
Fig.6
Fig.8
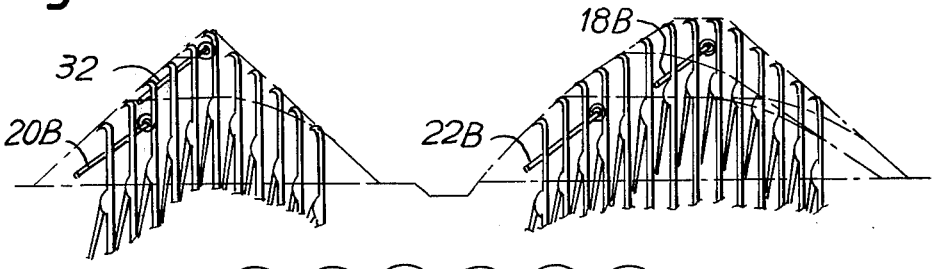
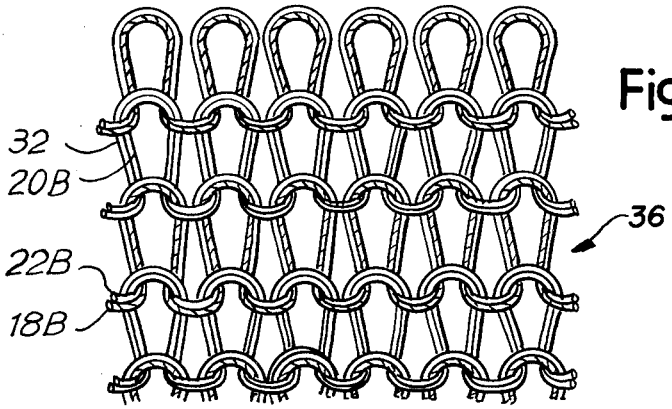
Fig.9

KNIT TUBULAR ARTICLE WITH TRANSVERSE WAIST OPENING

BACKGROUND OF THE INVENTION

In the knitting of one-piece panty hose it is conventional to form the waist opening during the knitting operation as described, for example, in U.S. Pat. No. 3,673,821 to Johnson. In most instances the waist opening is defined by a cut or slit extending wale-wise along the knitted fabric, that is in the direction of knitting. This is objectionable because in the finished product the dimension between the waist opening and the crotch is limited by the diameter of the knitting machine, which is conventionally about four or four and one half inches.

There have been prior attempts to form the waist opening during knitting on a circular knitting machine in a direction transverse to the direction of knitting or course-wise of the knitted article, but considerable difficulty has been encountered in retaining the stitches bordering the waist opening.

SUMMARY OF THE INVENTION

According to the invention, the transverse opening is formed by clearing the needles from the stitches throughout a portion of the arc of needles and then the yarn is reintroduced to those same needles to resume knitting again. The fabric along an edge zone on each side of and adjacent the ends of the transverse opening comprises courses having an added elastic yarn. The portions of such an edge zone adjacent the lips of the opening provide the fabric with retained or tuck stitches that hold well and offer high elasticity and a tendency to roll up along the opening edges or rims.

In the edge zone, preferably a course of stitches with an elastic yarn and a non-elastic yarn is formed alternately with a course of stitches having only non-elastic yarn. The retained stitches in the edge zone next to the lips of the opening are preferably a retained stitch. alternated with a usual stitch.

Adjacent the ends of the opening, the fabric may be suitably reinforced by introducing a supplementary yarn which is added into alternate courses in which the elastic yarn is not present. This reinforced fabric may have adjacent the lips of the opening an interlaced knitting effect such as that obtained by a 1:1 technique, while in the development of the remainder of the edge zone adjacent the ends of the opening, a plain stitch technique is used.

The invention also relates to an article formed by the above defined process.

The invention will be better understood following an understanding of the description and accompanying drawings, which illustrate a practical embodiment of the invention. In the drawing:

FIG. 6 is a schematic view illustrating the incoming yarns and needle setup for forming the fabric adjacent the lips of the opening near the end thereof;

FIG. 8 is a schematic view illustrating the incoming yarns and needle setup in the edge zone adjacent the ends of the opening;

FIG. 9 is a pictorail stitch diagram of the fabric in the zone defined by FIG. 8.

DETAILED DESCRIPTION OF THE INVENTION

Figure 1:
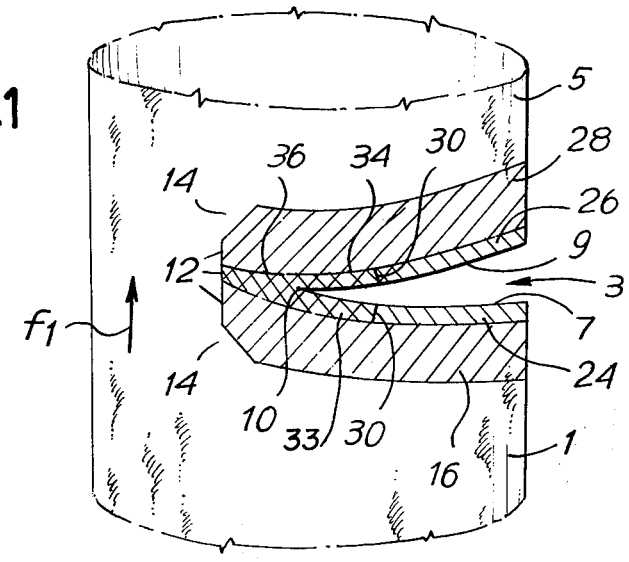
FIG. 1 is schematically illustrated of the development of the body portion of the panty hose in accordance with the present invention.

Turning now to FIG. 1 of the drawings, a length 1 of the panty hose is formed before or prior to the waist opening 3 with the knitting operation proceeding in the direction of the arrow $f_1$. The transverse opening 3 is then formed as described hereinafter, whereupon a second length 5 of fabric is subsequently formed.

The opening 3 is defined by a first lip 7 which is obtained by clearing an arcuate section of needles in the needle cylinder from the stitches immediately proceding the lip. This is accomplished conventionally by raising and subsequently re-lowering the needles without seizing yarn to form a new loop. The second lip 9, opposite lip 7 is begun in a conventional manner immediately after clearing of the section of needles to form lip 7 and preferably with a 1:1 needle selection, even though all the needles could be activated to restart the knitting operation. It is obvious that lips 7, 9 are formed between end points of the opening, one of which is indicated by 10 in FIG. 1.

Around the lips 7 and 9 of the transverse opening 3, different zones 16, 24, 26, 28, 33, 34, and 36 of fabric with respect to that of the tubular article 1, 5 are formed to constitute a finishing edge around the opening 3, said edge being preferably of the elastic type. In particular, along lines 12, 14 which may also be shaped, the insertion and disengagement of auxiliary yarns takes place for the forming of the aforesaid edge or welt. During the knitting of the article in the zone of the opening, the engagement and disengagement is effected by raising selected needles along the prescribed arc in such a manner as to pick up an auxiliary yarn in the edge zone.

Figure 2:
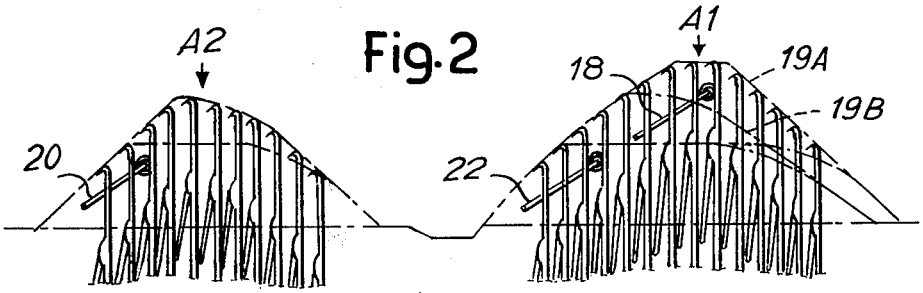
FIG. 2 is a schematic view illustrating the positioning of the incoming yarn and needle arrangment at two consecutive feeds in edge zone.
Figure 3:
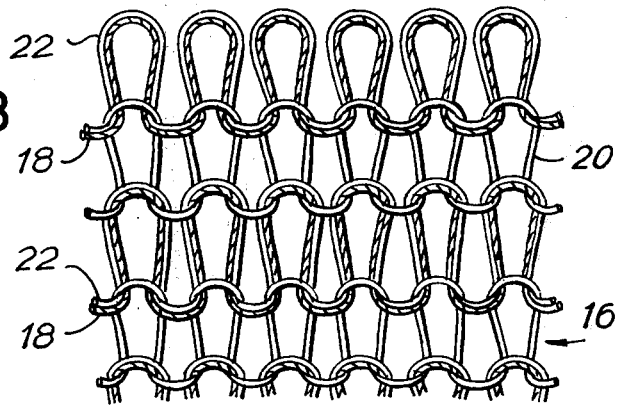
FIG. 3 is a pictorial stitch diagram illustrating the fabric formed from the setup of FIG. 2.

As the panty hose is formed in the direction of the arrow $f_1$, a first outer edge zone 16 of fabric is formed as shown in FIG. 3. An additional elastic yarn 18 is fed to alternating feeds in such a manner that fabric in the zone 16 includes a first course with the usual yarn 20 (feed A2 in FIG. 2) and a second course alternating therewith formed both by the usual yarn 22 and by an elastic yarn 18 (feed A1 in FIG. 2). The yarn 18 is siezed by needles raised in a conventional manner up to the path 19A. In the zones where the elastic yarn 18 is not to be seized, the needles are raised only to the path 19B to pick up only the yarn 22.

Figures 4, 5A:
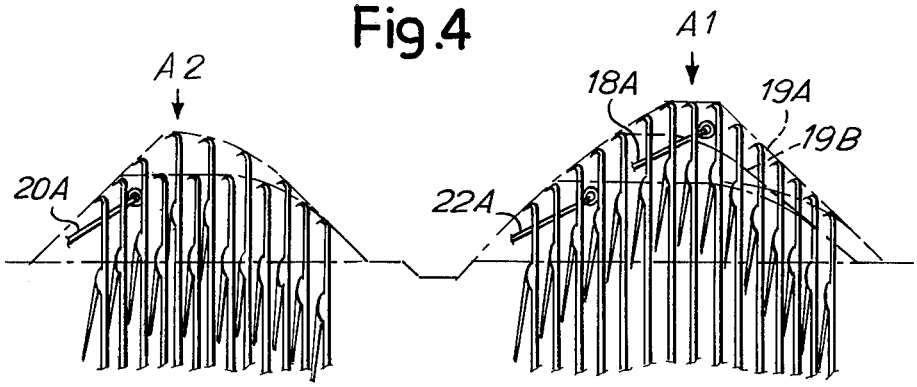
FIG. 4 is a schematic view illustrating the incoming yarns and needle setup at two consecutive yarn feeds in the area adjacent the lips of the opening of the panty hose.
FIG. 5A is a diagram of the stitch construction of FIG. 5.

After the forming of zone 16, a second edge zone 24 is formed immediately adjacent the lip 7. The fabric in zone 24 is modified in the structure to be more elastic, with an accentuated tendency to roll up and with a tendency to resist raveling or breakdown of the stitches. Toward this end (see FIGS. 4 and 5) in portion 24, feed A1 directs the usual or non-elastic yarn 22A and the elastic yarn 18A in the same manner as illustrated in FIG. 2 with the path of the needles along the trajectory 19A. The exclusion of the elastic yarn 18A during the knitting of the remainder of a cylinder rotation is obtained by lifting the needles only to the lower trajectory 19B.

Figure 5:
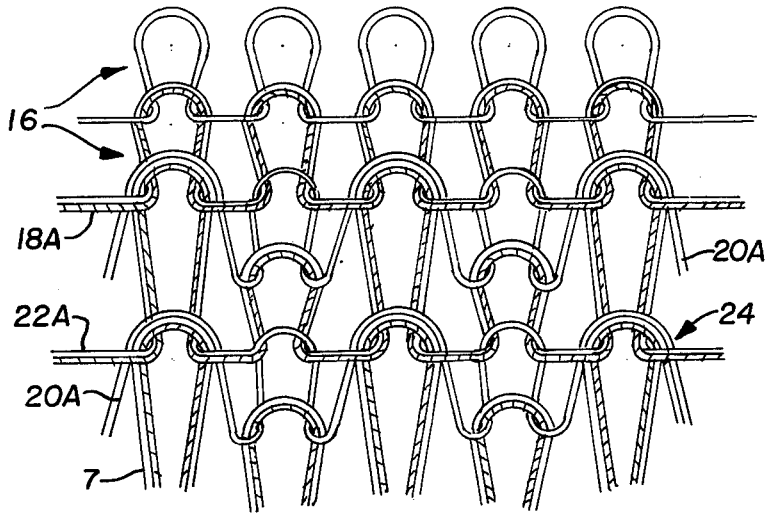
FIG. 5 is a pictorial stitch diagram illustrating the fabric in the zone of FIG. 4.

The difference between zone 24 and zone 16 occurs at the second feed A2 (FIG. 4) where non-elastic yarn 20A is introduced in alternate courses in alternating wales by means of a 1:1 needle selection in such a manner as to constitute the interlacing pattern shown in the lower portion of the fabric in FIG. 5. This interlacing pattern is formed in a greater number of courses than that shown in FIG. 5, where for drawing clarity, only two courses appear. The fabric structure thus formed in portion 24 provides increased elasticity of the fabric and a desired tendency to roll up along the final lip. The rolling tendency forms on one hand a protection against the raveling or breakdown of the stitches cast off along the final lip 7.

Once knitting is resumed after opening 3 is formed along the lip 9, a zone 26 is formed similar to zone 24. Subsequently another outer edge zone 28 is formed similar to zone 16. In the arc of needles outside and corresponding to that of the zones 16, 24, 26, 28, the knitting is continued as in the length 1. After formation of zone 28 knitting is continued on all needles throughout the length 5 as in length 1.

Figure 7:
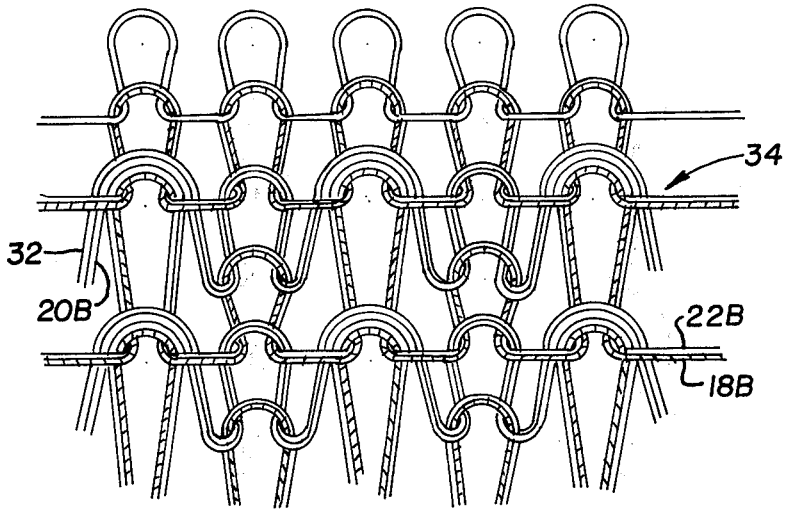
FIG. 7 is a pictorial stitch diagram illustrating the fabric in the area of FIG. 6.

Adjacent the ends 10 of the transverse opening 3, a reinforced fabric is formed to better withstand the stresses which occur during use. In the portion between the line 12 and the two marking lines 30 indicated in FIG. 1, a supplementary, preferably non-elastic yarn 32 is introduced (see FIGS. 6 to 9) at the same feed A2 where yarn 20B is introduced. Yarn 20B corresponds with the yarn 20, 20A in zones 16, 24. Feed A1 still introduces the non-elastic yarn 22B and the elastic yarn 18B as in zones 16, 24. In the zones 33, 34 of the reinforced fabric, which are developed along the edges 7 and 9, the reinforced fabric assumes the interlaced structure shown in FIG. 7, as the stitch at feed A2 is made b 1:1 and each stitch is constituted respectively with the two yarns 18B, 22B in one course and yarns 20B, 32 in the next course. In the zone 36 which is included between the line 12 and the point 10 as an extension of the zones 33 and 34, the fabric is made with a plain stitch as shown in FIG. 9, one course being formed by the yarns 32 and 20B and the other course formed by the yarns 18B (elastic) and 22B (non-elastic). The fabric in the zones 34, 36 thus formed is particularly strong to withstand stresses during use. The article at the outer ends of the portions 1 and 5 may be completed with closure structure known as "closed toes".

It is apparent that the drawing and specification illustrate one embodiment which may be varied without departing from the scope of the invention which is to be determined by the following claims.

What is claimed is:

1. A knit construction for the waist portion of a one-piece panty hose comprising a tubular knit portion having a waist opening therein extending partially around the circumference of said tubular portion and having a transverse dimension greater than its longitudinal dimension, an outer edge zone on each side and at each end of said opening and said outer edge zone having an elastic yarn in selected courses thereof, another edge zone immediately adjacent each side edge and each end of said opening selected loops of selected courses formed with the corresponding loops of the succeeding course whereby the fabric along the edges of said opening offer a high degree of elasticity and an tendency to roll up.

2. The construction according to claim 1 wherein said outer edge zone includes courses having stitches with both elastic and non-elastic yarns alternated with courses having only non-elastic yarn.

3. The construction according to claim 1 wherein said other edge zones include selected courses having usual stitches alternated with tuck stitches.

4. The construction according to claim 2 wherein the portion of said other edge zones adjacent the ends of said openings includes a supplementary reinforcing yarn in the courses which include only the non-elastic yarn.

* * * * *